United States Patent [19]

Wallis

[11] Patent Number: 4,753,096

[45] Date of Patent: Jun. 28, 1988

[54] APPARATUS FOR CONTROLLING HEIGHT OF CORRUGATIONS FORMED IN A CONTINUOUS LENGTH OF STRIP STOCK

[76] Inventor: Bernard J. Wallis, 2115 Dacosta, Dearborn, Mich. 48128

[21] Appl. No.: 937,922

[22] Filed: Dec. 4, 1986

[51] Int. Cl.[4] ..... B21D 13/04

[52] U.S. Cl. ..... 72/196

[58] Field of Search ..... 72/196

[56] References Cited

U.S. PATENT DOCUMENTS

| | | | |
|---|---|---|---|
| 3,367,161 | 2/1968 | Avakian | 72/196 |
| 4,033,492 | 7/1977 | Imai | 72/205 |
| 4,059,000 | 11/1977 | Bodnar | 72/196 |

FOREIGN PATENT DOCUMENTS

| | | | |
|---|---|---|---|
| 421135 | 3/1984 | Japan | 72/196 |

*Primary Examiner*—Lowell A. Larson

*Attorney, Agent, or Firm*—Barnes, Kisselle, Raisch, Choate, Whittemore & Hulbert

[57] ABSTRACT

In a machine for corrugating a continuous length of strip stock fed between a pair of corrugation rollers, apparatus controls height of corrugations formed by the rollers by selectively varying tension on the strip stock fed between the rollers. Such apparatus includes a sensor for measuring actual height of corrugations formed by the rollers, and a clutch for applying tension to the strip stock upstream of the rollers, with the height of corrugations varying as a direct function of tension applied to the strip stock. A tension sensor is positioned between the clutch and the forming rollers for measuring tension applied to the strip stock and controlling the clutch accordingly.

15 Claims, 2 Drawing Sheets

FIN HEIGHT ADJUST
TENSION ADJUST
MONITOR FIN HEIGHT
68
TENSION CONTROL
70
A/D
64
A/D
62
D/A
66
DISTANCE SENSOR ELECTRONICS
52
TENSION SENSOR ELECTRONICS
42
CLUTCH DRIVE
32
EDDY CURRENT DISTANCE SENSOR
48
TENSION SENSOR
40
MAGNETIC PARTICLE CLUTCH
30
10
12
14
16
18
20
22
24
26
28
34
36
38
44
46
50
54

APPARATUS FOR CONTROLLING HEIGHT OF CORRUGATIONS FORMED IN A CONTINUOUS LENGTH OF STRIP STOCK

The present invention is directed to machines for corrugating a continuous length of strip stock to form heat exchanger strips or the like and more particularly to a method and apparatus for continuous control of corrugation height.

BACKGROUND AND OBJECT OF THE INVENTION

Typical apparatus for manufacture of metallic strips having corrugations extending transversely of strip length are disclosed in U.S. Pat. Nos. 3,998,600, 4,067,219, 4,262,568 and 4,507,948. In general, a continuous length of ribbon or strip stock is fed from a stock coil between one or more pair of opposed rollers having intermeshing teeth for forming corrugations or fins in the strip stock passing therebetween. Corrugation height is generally determined by design of and separation between the corrugation rollers. However, fine adjustment of corrugation height, particularly "on the fly" adjustment during operation of the machine, is at best difficult in the machines heretofore proposed.

A general object of the present invention, therefore, is to provide a machine for corrugating continuous length of strip stock of the described character which includes facility for convenient and rapid adjustment and control of corrugation height as the machine is operating. A more specific object of the invention is to provide a corrugation machine having height control apparatus of the described character which is economical to fabricate, which may be readily implemented by way of retrofit in corrugation machines previously constructed, which is fully automatic in operation and/or which provides accurate adjustment of corrugation height with fine resolution and over an extended operating lifetime.

SUMMARY OF THE INVENTION

In accordance with a fully automated embodiment of the present invention, a machine for corrugating a continuous length of strip stock includes facility for feeding a continuous length of strip stock between at least one pair of corrugation rollers, and apparatus for controlling height of corrugations formed by the rollers by varying tension applied to the strip stock fed between the rollers. In the preferred embodiment of the invention herein disclosed, such apparatus comprises a non-contact sensor positioned downstream of the corrugation rollers for measuring actual height of corrugations formed in the ribbon stock. The resulting height-measurement signal is compared with desired corrugation height, and the difference forms a correction signal which drives a clutch for applying drag to the strip stock upstream of the corrugation rollers. The clutch preferably comprises a magnetic particle clutch coupled to a roller over which the strip stock is trained for selectively retarding rotation of the roller. The preferred embodiment of the invention also includes facility for measuring tension applied to the strip stock by the variable clutch, comparing such tension to the height correction signal, and modifying the clutch drive signal accordingly.

In a second semiautomatic embodiment of the invention, the height measurement and/or tension measurement signals are fed to suitable displays, such as analog or digital display devices. Clutch drag is then manually controlled by an operator. Such semiautomatic device finds important retrofit applications, and represents a significant advance over the art wherein product samples must be manually inspected for fin height measurement, and a pneumatically-driven drag platten is adjusted in an attempt to control fin height. A significant amount of scrap is developed while such manual inspection is performed, and pressure variation in the pneumatic cylinder does not yield desired accuracy in the art.

BRIEF DESCRIPTION OF THE DRAWINGS

The invention, together with additional objects, features and advantages thereof, will be best understood from the following description, the appended claims and the accompanying drawing in which:

DETAILED DESCRIPTION OF PREFERRED EMBODIMENTS

Figure 1:
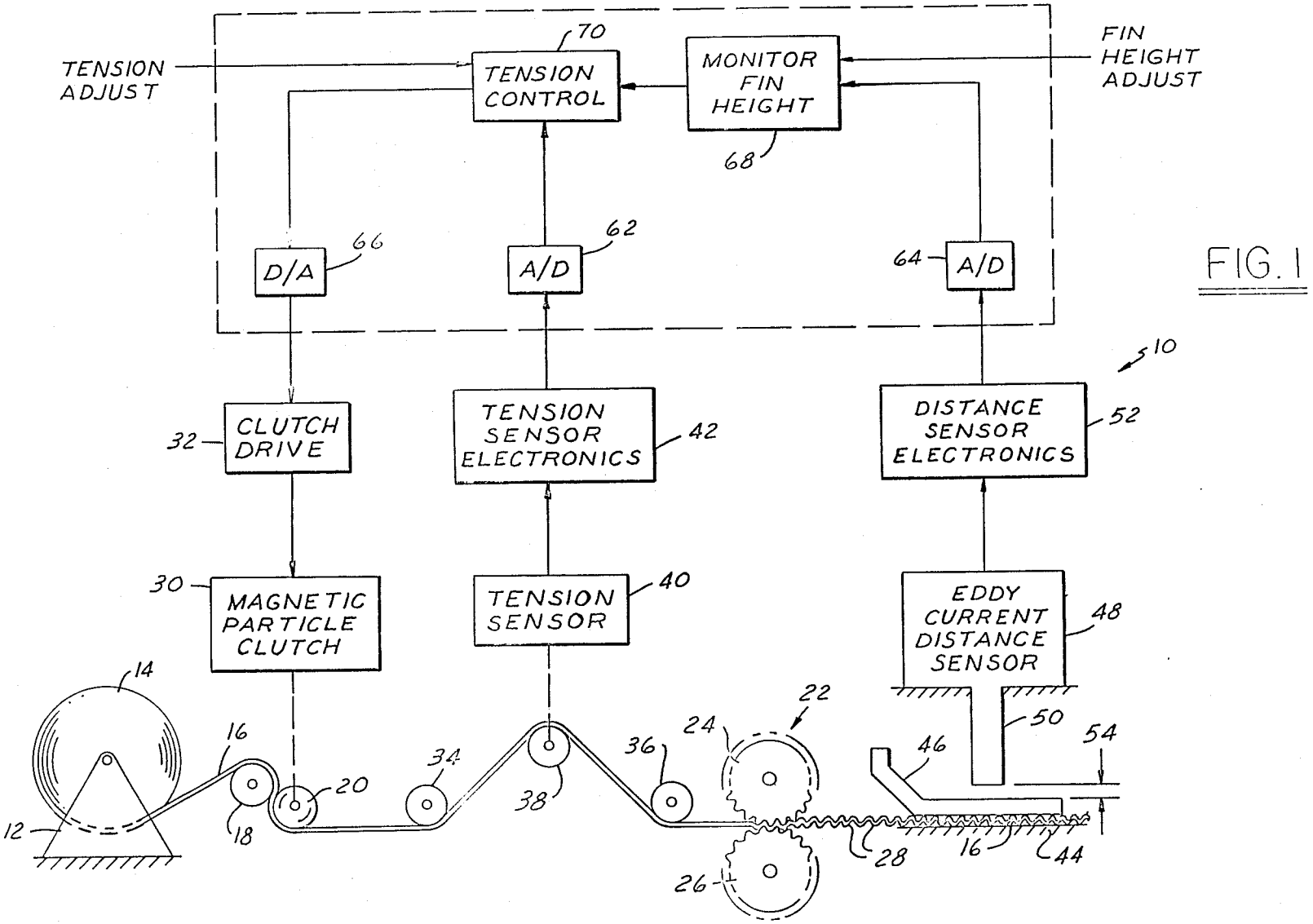
FIG. 1 is a functional block diagram of a strip corrugation machine which includes corrugation height and control apparatus in accordance with a presently preferred embodiment of the invention.

FIG. 1 illustrates a corrugation machine 10 in accordance with a presently preferred embodiment of the invention as comprising a stand 12 for supporting a coil 14 of strip stock 16. Stock 16 is fed from coil 14 around and between a pair of idler rollers 18, 20, and then between at least one pair 22 of toothed rollers 24, 26 for forming corrugations or fins 28 in the continuous length of stock 16. To the extent thus far described, apparatus 10 is of generally conventional construction as illustrated in the several United States patents noted above, the disclosures of which are incorporated herein by reference.

A clutch 30 is mechanically coupled to roller 20 and is responsive to electronic signals from a clutch drive 32 for selectively retarding rotation of roller 20 and thereby applying tension to strip stock 16 fed to corrugation roller pair 22. A pair of spaced idler rollers 34, 36, positioned between clutched roller 20 and corrugation rollers 24, 26, train strip stock 16 around an intermediate idler roller 38. Roller 38 is mechanically coupled to a tension sensor 40 for feeding an electrical measurement signal to tension sensor electronics 42. Downstream of roller pair 22, the corrugated strip stock is fed over a fixed support 44. A measurement shoe 46 intermittently or continuously engages corrugated stock 16 in opposition to support 44 and urges stock 16 against support 44. Thus, the position of shoe 46 with respect to fixed support 44 varies as a function of corrugation height. A non-contact sensor 48 is disposed in fixed position relative to support 44, and includes a probe 50 responsive to position of shoe 46 for providing a corrugation height measurement signal to sensor electronics 52 as a function of distance or separation 54 between probe 50 and shoe 46.

In a working embodiment of the invention, shoe 46 is of electrical conductive metallic construction, and sensor 48 comprises an EMDT eddy current sensor Model 4943 marketed by Electro Corp. of Sarasota, Fla. Distance sensor electronics 52 comprises a Model 3PA12D43 EMDT package likewise marketed by Electro Corp. Tension sensor 40 comprises a Model SSTS- P50 web tension sensor marketed under the trade designation Magpower by Magnetic Power Systems, Inc. of Fenton, Mo. Clutch 30 comprises a Model C-50 magnetic particle clutch, and clutch drive 32 and sensor electronics 42 are combined in a Model 3TRAC2 tension controller, both likewise marketed by Magnetic Power.

A central controller 60 receives tension and corrugation height measurement signals from electronics 42, 52 through respective a/d converters 62, 64, and provides a corresponding signal to clutch drive electronics 32 through a d/a converter 66. More specifically, corrugation or fin height monitoring electronics 68 receives the height measurement signal from converter 64, compares such measurement signal to a fin height adjustment signal received from an operator or remote source (not shown), and provides a corresponding correction signal to tension control electronics 70. Tension control electronics 70 compares such correction signal to actual tension measurement from converter 62, and provides a corresponding drive signal to converter 66 for varying energization of clutch 30. Tension control electronics 70 also receives an initial tension adjustment from an operator or remote electronics (not shown).

In operation, tension applied by clutch 30 to strip 16 is initially set at a desired level, such as 25%, empirically selected nominally to maintain a finished corrugation height of 0.375 inches, for example. Tension controller electronics 70 monitors tension sensor 40 and drives clutch 30 to set tension at the desired level. In the event that actual corrugation height detected at sensor 48 differs from the desired corrugation height fed to monitor 68, a correction signal to tension control electronics 70 correspondingly varies energization of clutch 30. For example, if sensor 48 detects that corrugation height has exceeded desired fin height by a selected threshold, tension on strip 16 may be increased, either by an incremental amount such as 2%, or as a continuous function of corrugation height differential. Such increased tension on strip reduces the height of corrugations produced by rollers 24, 26. Indeed, corrugation height varies as a direct function of such applied tension. However, tension correction is not immediately manifested in a fin height change. Rather, the correction procedure is of an iterative nature, with controller 60 monitoring effects for a predetermined period of time or a predetermined length of corrugated stock before implementing further tension adjustment responsive to fin height measurement.

Figure 2:
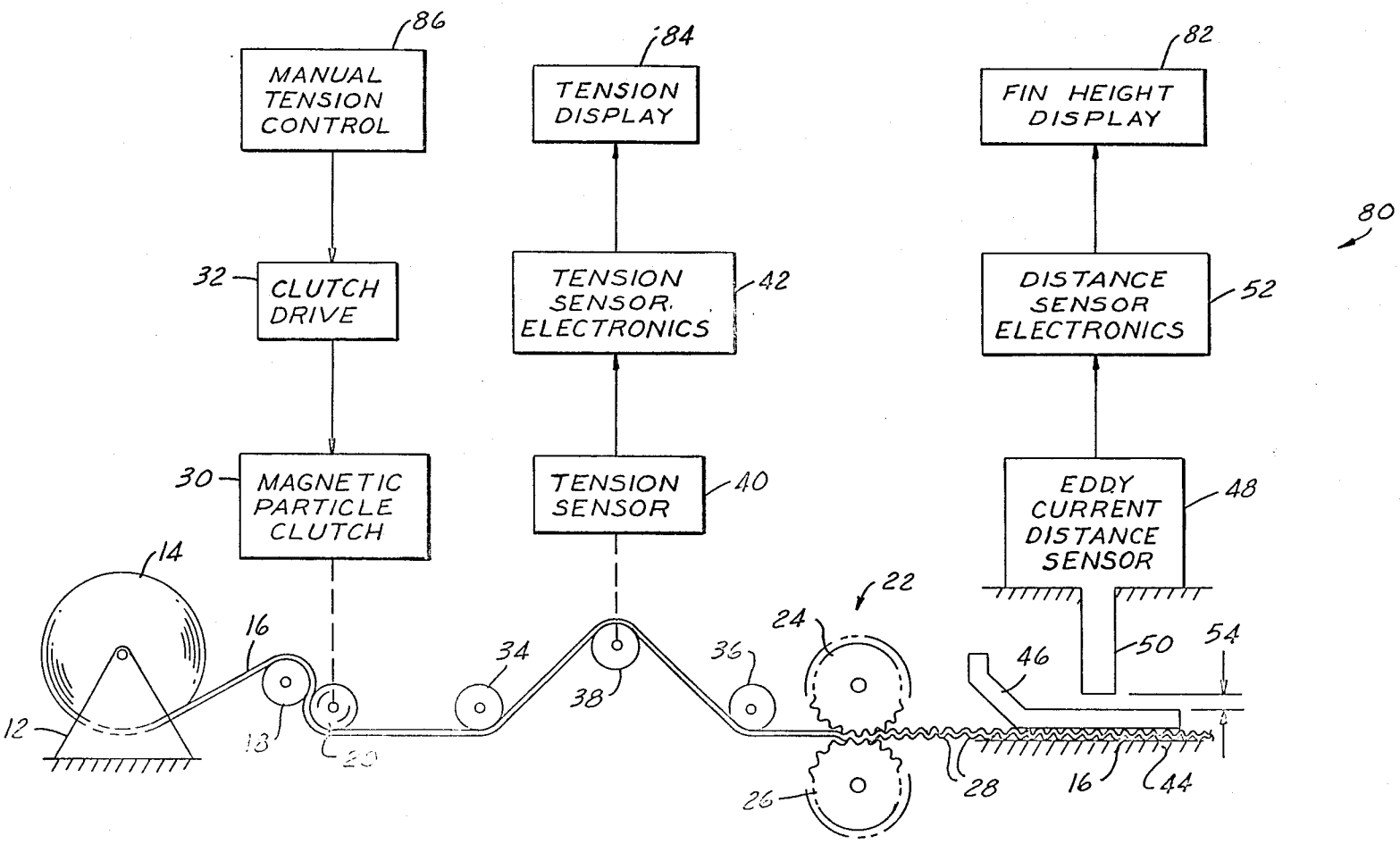
FIG. 2 is a functional block diagram of a semiautomatic embodiment of the invention.

FIG. 2 illustrates a semiautomatic embodiment 80 of a system in accordance with the invention. Elements in the embodiment of FIG. 2 which are identical to corresponding elements in FIG. 1 are designed by correspondingly identical reference numerals. In the embodiment of FIG. 2, a fin height display 82, such as an analog or digital display, receives and continuously displays the fin height signal for electronics 52. Likewise, a tension display 84 receives and continuously displays the output of tension sensor electronics 42 as a quantitative measure of tension applied to the sheet stock. A manual tension control 86, such as a rheostat or other suitable device, is coupled to clutch drive 32 for adjusting tension applied by clutch 30 to strip stock 16.

It will be apparent that electronic tension control as in the embodiments of FIGS. 1 and 2 is much more consistent and reliable than pneumatically-driven plattens or the like as heretofore proposed. Likewise, automatic fin height measurement and display at 82, either continuously or intermittently with suitable signal-holding electronics, is both more rapid and more reliable than separate manual measurement as in the art. A particular advantage of the embodiment of FIG. 2 is that such embodiment may be implemented in sections—e.g. retrofit of and existing with automatic fin height display, followed by later addition of electronic tension control.

It will be appreciated, of course, that controller 60 may be readily implemented in the form of analog circuitry rather than digital circuitry as presently preferred, in which event converters 62, 64 and 66 would not be required. It will also be appreciated that the principles of the present invention are not limited to specific exemplary dimensions or sensing apparatus hereinabove disclosed by way of example. Controller 60 may also be implemented in a microprocessor-based controller conjointly with the power stock uncoiler disclosed in copending U.S. application Ser. No. 885,033 filed July 14, 1986 and assigned to the assignee hereof.

The invention claimed is:

1. In a machine for corrugating a continuous length of strip stock which includes a pair of corrugation roller means and means for feeding a continuous length of strip stock to said roller means, apparatus for controlling height or corrugations formed by said roller means comprising means positioned between said feeding means and said corrugation roller means for selectively and variably applying tension on the strip stock fed to said roller means, means for measuring height of corrugations formed in the strip stock by said roller means and providing a first measurement signal as a continuous function of said height, and means coupled to said tension-applying means and responsive to said measurement signal for varying tension applied to the strip stock as a direct function of said measurement signal, height of corrugations varying as a direct function of tension on the strip stock.

2. The machine set forth in claim 1 wherein said tension-applying means comprises a roller, means for training the strip stock around said roller, and clutch means coupled to said roller and responsive to said tension-varying means for selectively retarding rotation of said roller.

3. The machine set forth in claim 2 wherein said clutch means comprises a magnetic particle clutch and clutch drive means responsive to said tension-varying means for selectively driving said magnetic particle clutch.

4. The machine set forth in claim 1 wherein said height-measuring means comprises fixed support means positioned downstream of said corrugation roller means such that strip stock corrugated by said roller means is trained thereover, means for urging corrugated strip stock against said support means, and means for determining corrugation height as a function of position of said urging means.

5. The machine set forth in claim 4 wherein said height-determining means comprises non-contact sensing means responsive to position of said urging means for providing said first measurement signal.

6. The machine set forth in claim 5 wherein said urging means is of electrically conductive metallic construction, and wherein said non-contact sensing means comprises an eddy current sensor electromagnetically coupled to said urging means.

7. The machine set forth in claim 1 further comprising tension measuring means coupled to the strip stock between said tension-applying means and said corrugation roller means for providing a second measurement signal as a function of tension in the strip stock, and wherein said tension-varying means varies tension applied to the strip stock as a conjoint function of said first and second measurement signals.

8. The machine set forth in claim 7 wherein said tension varying means comprises means for comparing said first measurement signal to a preselected height standard for providing a correction signal as a function of a difference therebetween, and tension control means responsive to said correction signal for selectively energizing said tension-applying means.

9. The machine set forth in claim 8 wherein said tension control means comprises means for comparing said correction signal to said second measurement signal and energizing said tension-applying means as a function of a difference therebetween.

10. A method of corrugating a continuous length of strip stock which includes the step of feeding a continuous length of strip stock in the direction of its length between a pair of corrugation roller means having intermeshing means about their peripheries for forming corrugation in strip stock fed therebetween, characterized by comprising the additional steps of measuring height of corrugations formed in the strip stock by said roller means, and then variably controlling tension applied to the strip stock in the direction of its length as a direct function of measured corrugation height.

11. The method set forth in claim 10 wherein said strip of controlling tension in said strip stock comprises the steps of comparing measured corrugation height to a preselected standard, and selectively varying tension applied to said strip stock as a direct function of a difference therebetween.

12. In a machine for corrugating a continuous length of strip stock which includes a pair of corrugation roller means and means for feeding a continuous length of strip stock to said roller means, apparatus for controlling height of corrugations formed by said roller means comprising means for measuring height of corrugations formed in the strip stock by said roller means and providing a first measurement signal as a function of said height, and means positioned between said feeding means and said corrugation roller means for selectively and variably applying tension on the strip stock fed to said roller means as a direct function of said first measurement signal, height of corrugations varying as a direct function of tension on the strip stock.

13. The machine set forth in claim 12 wherein said tension-applying means comprises a roller, means for training the strip stock around said roller, and clutch means coupled to said roller and responsive to said tension-varying means for selectively retarding rotation of said roller.

14. The machine set forth in claim 13 wherein said clutch means comprises a electromagnetic clutch and clutch drive means for selectively driving said electromagnetic clutch.

15. In a machine for corrugating a continuous length of strip stock which includes a pair of corrugation roller means and means for feeding a continuous length of strip stock to said roller means, apparatus for controlling height of corrugations formed by said roller means comprising a roller positioned between said feeding means and said corrugation roller means, means for training the strip stock around said roller, and an electromagnetic clutch coupled to said roller for selectively retarding rotation of said roller and thereby applying tension to the strip stock fed to said roller means, and clutch drive electronics for selectively and variably applying electrical power to said clutch, height of corrugations formed by said roller means varying as a direct function of tension applied to said strip stock.

* * * * *